US007604711B2

(12) United States Patent
Bianchini

(10) Patent No.: US 7,604,711 B2
(45) Date of Patent: Oct. 20, 2009

(54) METHOD TO OPTIMIZE TEMPERATURE PROFILES DISPLACEMENT BATCH COOKING

(76) Inventor: Craig A. Bianchini, 137 Elm Rd., Allentown, PA (US) 18104

( * ) Notice: Subject to any disclaimer, the term of this patent is extended or adjusted under 35 U.S.C. 154(b) by 183 days.

(21) Appl. No.: 11/369,436

(22) Filed: Mar. 7, 2006

(65) Prior Publication Data

US 2006/0201640 A1 Sep. 14, 2006

Related U.S. Application Data

(60) Provisional application No. 60/659,659, filed on Mar. 8, 2005.

(51) Int. Cl.
*D21C 9/10* (2006.01)

(52) U.S. Cl. ..... 162/40; 162/17; 162/29; 162/30.11; 162/43; 162/237

(58) Field of Classification Search ..... 162/29, 162/17, 41, 30.11, 43, 237
See application file for complete search history.

(56) References Cited

U.S. PATENT DOCUMENTS 2,996,422 A * 8/1961 Durant et al. ..... 162/19
2003/0111200 A1* 6/2003 Prough et al. ..... 162/233

FOREIGN PATENT DOCUMENTS

WO WO 2002036876 A1 * 5/2002
WO WO 2004005609 A1 * 1/2004

OTHER PUBLICATIONS

Sezgi et al., A combined discret-continuous simulation of an RDH tank farm,1994,TAPPI Journal, Vol. 77, No. 7.*

* cited by examiner

*Primary Examiner*—Eric Hug
*Assistant Examiner*—Anthony J Calandra
(74) *Attorney, Agent, or Firm*—Design IP

(57) ABSTRACT

Method and apparatus for batch displacement digester systems to increase tank farm vessel temperatures for more efficient delignification rates by mitigating the formation of flow channels in the chip bed, minimizing the vertical temperature gradient in the digester and segregation of returning liquors to the tank farm from the digester.

2 Claims, 2 Drawing Sheets

METHOD TO OPTIMIZE TEMPERATURE PROFILES DISPLACEMENT BATCH COOKING

This application claims priority to U.S. Provisional Application Ser. No. 60/659,659, filed Mar. 8, 2005.

BACKGROUND OF THE INVENTION

This present invention relates to improved methods and apparatus for delignifying cellulosic material in modern displacement batch digester systems.

In conventional batch pulping operations, the wood material (softwoods, eucalyptus, or hardwoods) or the lignocellulosic crop material (e.g., bagasse, bamboo, kenaf, reeds, and so forth) is reacted with cooking liquor for a given time at a specified temperature. The cooking chemistry may be kraft (sulfate), sulfite or other.

Conventional batch reactors (digesters) used for producing fibrous cellulose from fiber bearing sources, such as wood, have traditionally been filled simultaneously with the wood chips and cooking chemicals required to liberate the cellulosic fiber. Recently, new processes have emerged that reuse the spent cooking liquor that have been displaced from previous batch cooks (spent liquor) to save energy and to take advantage of the residual chemicals in the spent liquor. These new types of cooking systems require that the stored spent liquor is pumped into the digester for reuse, referred to as the displacing liquor, to replace the liquor inside the digester, referred to as the displaced liquor, with the displaced liquor exiting the digester. Hence, they are referred to as Displacement Batch Digesters.

In order for all the contents of the digester to have the same chemical activity and to produce consistent quality pulp, the liquor that is pumped into of the digester must flow in a plug flow (i.e. no channeling) profile. The fluid dynamics of this type of arrangement favors the liquors to follow the path of least resistance which is to flow against the smooth outer digester walls or to force an open channel through the chip bed in the digester instead of flowing uniformly through the chip bed. Therefore, the fluid tends not to form a plug flow profile and the contents of the digester are not exposed to the same chemicals and temperatures.

The liquor inside the digester is replaced in phases or steps. A distinct step is defined by the specific source of the displacing liquor that is pumped to the digester. A different step infers that different temperature liquor from a distinct source vessel (tank or pressure vessel) is displacing the digester contents. The different temperature displacing liquors from the tank farm initially are used to heat the digester, and after the high temperature reaction phase of the cooking cycle is completed, to cool the digester. At the start of the cooking cycle, previously stored spent cooking liquors hotter than the temperature of the digester contents are the displacing liquors so as to impart the thermal and chemical energy to the digester's cellulosic feed material, such as wood. At the end of the cooking cycle after the high temperature reaction phase is completed, cool washer filtrate is the displacing liquor and the digester's hot spent liquor, the displaced liquor, is displaced from the hot digester and stored in the appropriate tank farm vessel for reuse in subsequent cooking cycles.

The reuse of the hot spent cooking liquor requires a tank farm composed of atmospheric tanks as well as pressure vessels to store displaced liquors over 100° C. The pressure vessels are referred to as accumulators since they accumulate the displaced return liquors at temperatures above atmospheric flash points from the digester for reuse. The displaced liquors are segregated by temperature in the tank farm with the coolest displaced liquor under around 95° C. from the digester being diverted to the atmospheric tank. The liquors above around 95° C. displaced from the digester are diverted to the first lowest temperature accumulator with the next hottest displaced liquors diverted to one or more higher temperature accumulator(s). Note that the temperatures of the liquor deposited in to each receiving vessel is actually a range of temperatures since the displacing liquor, which later becomes the displaced liquor, is exchanging thermal energy with the digester contents over the period of the displacing operation.

U.S. Pat. Nos. 4,814,042; 6,719,878; 5,800,674; 4,578,149; 4,601,787; 6,103,057; 5,059,284; 5,080,757; 4,849,052; 6,139,689; 4,764,251; 4,670,098; 4,764,251; H1,681; 4,764,251; 6,306,252; 6,346,166; 6,346,167; 6,350,348; 6,391,628; 6,451,172 and 6,514,380 disclose various aspects for the delignification (cooking) process of displacement batch digesters for providing cellulosic pulp.

BRIEF SUMMARY OF THE INVENTION

The present invention pertains to methods and apparatus for a Displacement Batch Digester system to increase the chemical and thermal performance by maximizing the tank farms' stored liquor temperatures and/or by mitigating the creation of a channel in the chip bed by controlling the differential pressure drop across the digester as the displacing liquors are pumped through the digester. According to another aspect the present invention teaches controlling and increasing the temperature of the liquors in the lowest temperature accumulator by; a) allowing the first displacing step to continue, or extend, by displacing a larger volume of liquor through the digester, so that there is little or no vertical temperature gradient in the digester after this step is complete and b) segregating in the tank farm the additional volume of displaced liquors from the extending of the first displacement step in a separate vessel or compartment so that the other returning displaced liquors to the tank farm from the other displacing steps are not mixed with these relatively lower temperature liquors.

The method to mitigate channel creation is to control the differential pressure drop across the digester that the displacing and displaced liquors are subject to, especially at the end of the cooking cycle when the displacing liquor is cooler than the displaced liquor and the cellulose has been freed from the raw material.

The method and apparatus to control and increase the temperature of the liquors in the lowest temperature accumulator is to ensure that the digester temperature profile is constant vertically (top to bottom) after the first displacing step and segregating the additional volume of displaced liquors required with a diversion pipe to a new storage compartment so that subsequent displacing steps do not use displacement liquor with a temperature substantially below that of the liquor in the lowest temperature accumulator The hotter displaced and stored liquors would be thermally diluted (cooled) if this were permitted.

In summary, both methods stabilize the temperatures in the tank farm by minimizing the temperature swings from channeling relatively cool displacing liquor through the digester and by segregating the relatively cool displaced liquors from the hotter liquors.

DETAILED DESCRIPTION OF THE INVENTION

Figure 1:
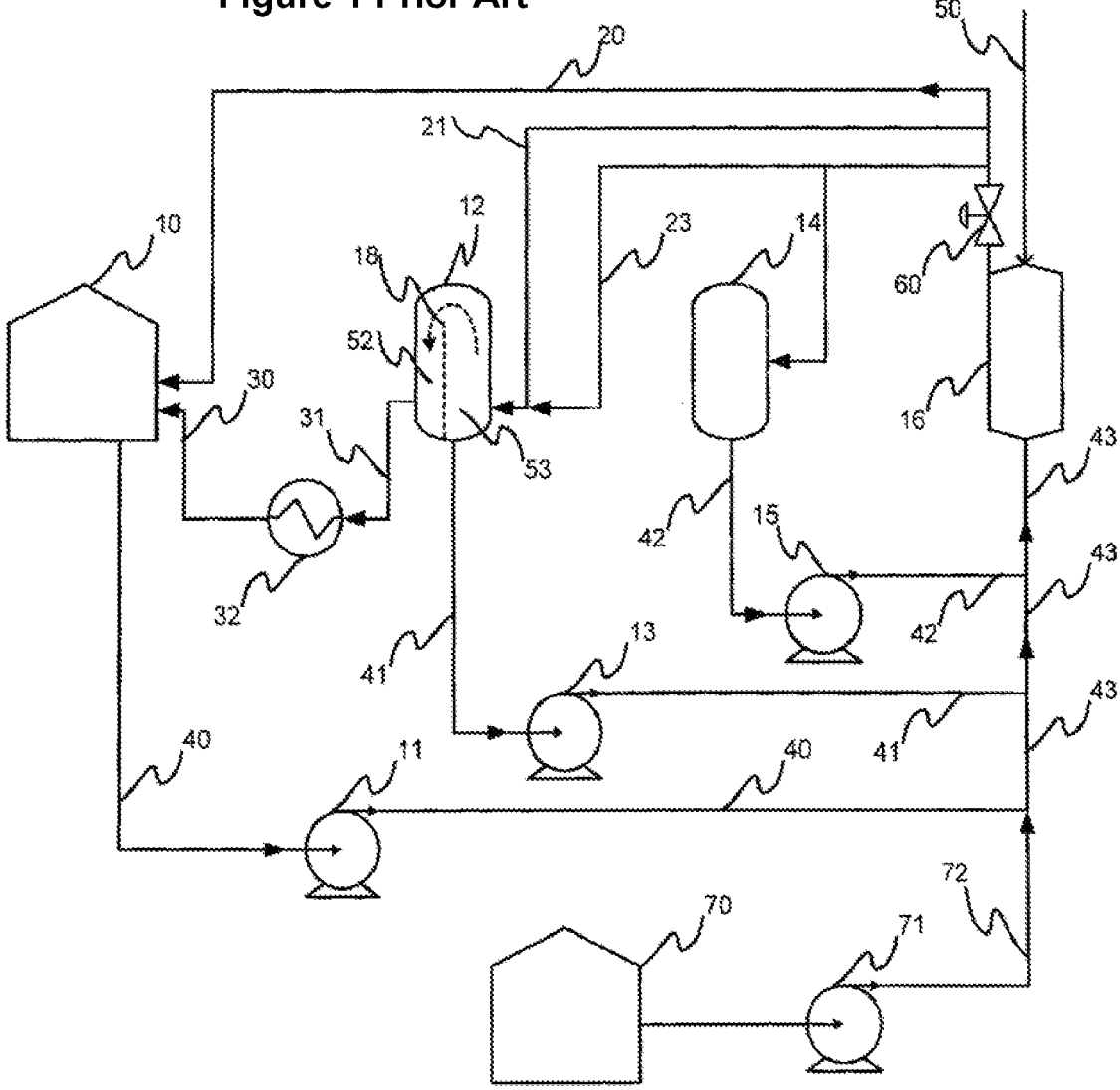
Figure 1 Prior Art
FIG. 1 is a schematic representation of a typical existing displacement digester system tank farm representing prior art.

Referring to FIG. 1 as the existing standard prior art, a batch digester 16 is used to pulp or cook lignocellulosic material. As part of the displacement digester cooking process, the digester 16 is filled with cellulose bearing material 50 until somewhat filled. Liquor from the atmospheric storage tank 10 at temperature around 85° C., the displacing liquor, is pumped through line 40 using pump 11 into the bottom of the digester 16 with any displaced liquor exiting the top of the digester 16 through the pressure control valve 60 and line 20 back to the atmospheric tank 10. The second displacement step uses liquor from the lowest temperature accumulator 12 as the displacing liquor. During this second liquor filling step, the displacing liquor at around 110 to 115° C. from the lowest temperature accumulator 12 (or from the storage side of the accumulator 53 if baffle 18 is present) is pumped using pump 12 through line 41 into the bottom of the digester 16 with the displaced liquor exiting the top of the digester 16 through pressure control valve 60 and line 20 until the displaced liquor temperature reaches near flashing or above 95° C. for safety reasons since the atmospheric storage tank 10 is not a pressure vessel and it's contents must remain below 100° C. Since material inside the digester 16 is heated from the bottom to the top, a resulting temperature gradient from around 110 to 115° C. at the bottom to only around 95° C. at the top is naturally formed. The next displacement step(s) in the cooking cycle uses displacing liquor at around 145 to 160° C. (depending on the number of accumulators) from the next higher temperature storage accumulator 14 is pumped using pump 15 through line 42 into the bottom of the digester 16 with the displaced liquor starting at around 95° C. through pressure control valve 60 and line 21 going back to the lowest temperature accumulator 12 (or to the storage side of the accumulator 53 if baffle 18 is present). The initial displaced liquor around 95° C. cools the liquor in the lowest temperature accumulator 12 (or the storage side of the accumulator 53 if baffle 18 is present) which creates an average temperature 115° C. after mixing with hotter liquors from the final step in the cooking cycle.

After the high temperature phase of the digesting is completed in digester 16, cool washer filtrate liquor at around 80° C., the displacing liquor, from the washer filtrate is pumped through line 43 and 72 to the bottom of the digester to displace the spent cooking liquor from the digester 16 forcing it out the top through the pressure control valve 60 and line 22, first to the higher temperature accumulator 14 (or others) and finally to the lowest temperature accumulator 12 (or to the storage side of the accumulator 53 if baffle 18 is present). The diversion of the liquor is based on mass balances and temperatures as the temperature of the displaced liquor temperature decreases as more displaced liquors exit the digester and the digester contents are cooled by mixing with to the relatively cool displacing liquor. The final displacing step of hot liquor from the digester is the method used to store spent liquor energy in the tank farm for further reuse by transferring thermal and chemical energy from the digesters to the tank farm. On the other hand, the initial displacing steps described previously transfers this stored energy from the tank farm to the digesters for reuse. Therefore, if there is channeling (or short circuiting) of the cool displacing washer filtrate at 80C from washer filtrate tank 70 directly to the top of the digester 16 liquor being displaced, the incorrect temperature liquors will be diverted to the incorrect storage accumulator(s) which will not impart the correct thermal energy and consequently the temperatures in the tank farm vessels will decrease and ultimately will not transfer the correct thermal and chemical energy back to the subsequent cooking cycles.

The total amount of displaced liquor diverted to the lowest temperature accumulator 12 (or to the storage side of the accumulator 53 if baffle 18 is present) are in excess of what is needed for the initial displacing step described above used to heat the digester contents. The excess liquor from the lowest temperature accumulator 12 is released thorough line 31 to liquor cooler 32 then through line 30 to the atmospheric tank 10. Some commercial installations have a baffle 18 in the lowest temperature accumulator 12 which this excess liquor will flow over into the outlet side of the vessel 52 then through line 31 to the liquor cooler 32 then through line 30 to the atmospheric tank 10. The existence of a baffle 18 has no bearing on the temperature of the liquor in the storage side 53 of the lowest temperature accumulator 12 since all displaced liquors diverted to the lowest temperature accumulator 12 are sent to the storage side 53 and inherently mixed in the vessel (i.e. no segregation).

The prior art function of the digester outlet pressure control valve 60 is to control the digester 16 pressure above the flash point of the digester contents. It does not have any control function to the pressure drop across the digester or as part of the series flow circuit of displacing and displaced liquors. This implies that the pressure control valve 60 can increase or decrease the pressure drop across the digester contents and decrease or increase the potential of channeling. This has been observed in the field.

Figure 2:
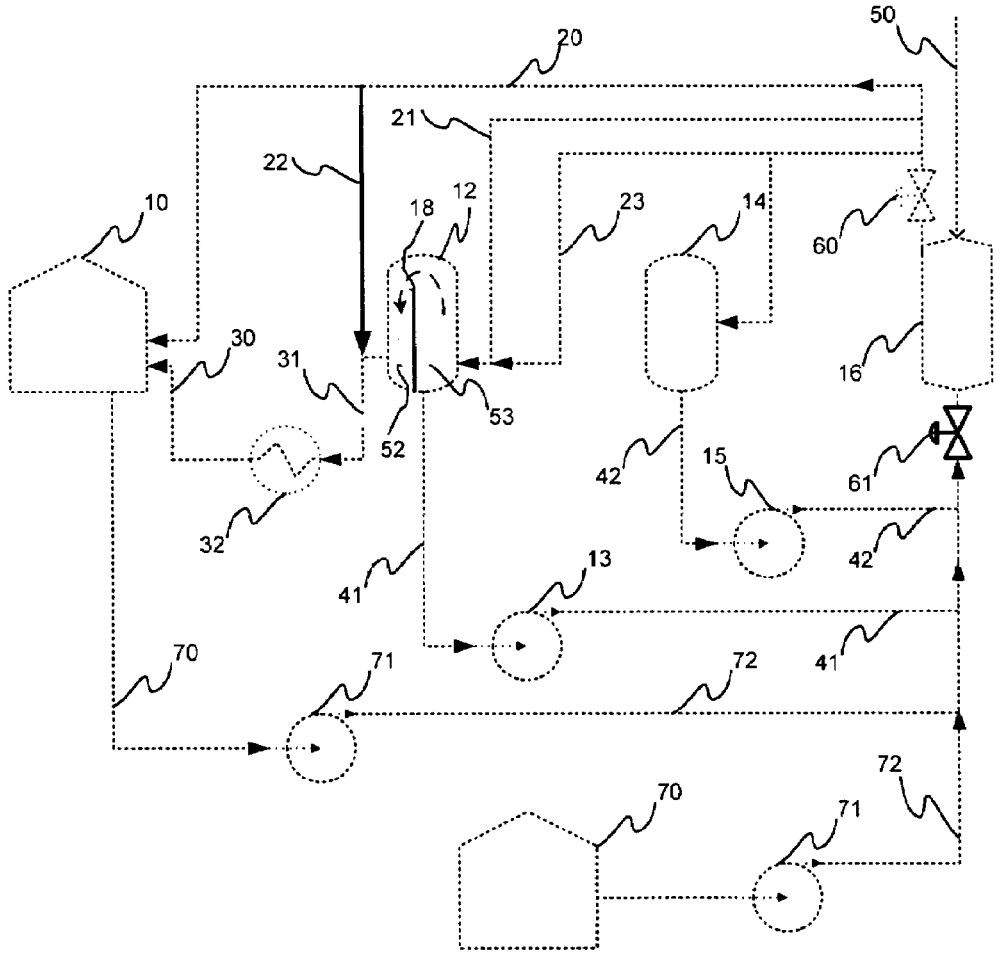
FIG. 2 is a schematic representation of the present invention as a modification to the prior art tank farm and cooking method.

Therefore, in one aspect the present invention is a method to minimize the creation of a channel in the chip bed by the displacing liquors that are pumped through the digester by adding a new control valve at the bottom (inlet) of the digester so that the pressure drop across the digester is controlled at near constant value. A constant flow of liquor through the digester is required to maintain consistent cooking cycle times between the various digesters for stable product production. Varying flow rates create varying cooking times because the same volume of displacing liquor is required for all cooking cycles to heat or cool the digester contents per the heat balance. This constraint of constant volume and volumetric flow rate requires that the total pressure drop for the flow circuit of the displacing and displaced liquors must be constant to maintain the flow rate necessarily constant from the production constraints. As the natural pressure drop through the digester due to the geometry and packing density of the raw material in the digester is variable, a control scheme and the new differential pressure control valve is needed to maintain a stable and minimum pressure drop through the digester chip bed which consequently mitigates channeling behavior. The prior art teaches that the process is to use only a control valve at the outlet of the digester to maintain a certain static digester pressure. This outlet control valve is unable to control the pressure drop across the digester. At times the chip bed will be at a higher pressure drop and at other times the pressure control valve will be the higher pressure drop. A higher pressure drop across the chip bed imparts increased momentum forces to the chips that is alleviated by the formation of channels. Therefore, it is beneficial if control valves and not the chip bed is the higher pressure drop. The prior art total displacement and displaced liquor flow circuit pressure drops include the independent variable chip bed, the outlet pressure control valve and the receiving vessel head pressure. As shown in FIG. 2, the present invention requires the inclusion of an additional control valve 61 at inlet of the digester 16 so it is incorporated in the liquor flow circuit. The outlet valve 60 maintains the digester static pressure above flash point while the new inlet control valve 61 is used to adjust pressure for the independent variable chip bed to control the total pressure drop of the liquor flow circuit through the digester which mitigates channel formation inside the digester.

In another aspect of the present invention the first displacing step of the cooking cycle used to heat the digester is continued past the point when the displaced liquor exiting the digester reaches above around 95° C. to eliminate the vertical temperature gradient in the digester. The prior art requires the first displacing step, which uses liquor from the lowest temperature accumulator to displace air or liquor from the digester, to stop when the displaced liquor temperature exiting the digester reaches above around 95° C. because this displaced liquor during the first displacement step is diverted to the atmospheric storage tank and cannot be stored safely above around 95° C. The present invention allows the displaced liquors from the extended displacement at temperatures about 95° C. and above up to about the temperature of the displacing liquors from the lowest temperature accumulator during the first displacing step to eliminate temperature gradients in the digester and not allow these liquors to mix with other hotter displaced liquors from other displacement steps to maximize the thermal energy in and the general tank farm. This requires the use of a separate accumulator or a baffle in the lowest temperature accumulator to create a new storage compartment to segregate the first displaced liquors returning from the digester at or above around 95° C. and up to the temperature around the displacing liquor temperature during the first displacing step from any other hotter stored liquors that are stored from other displacement steps. This segregation precludes the dilution of thermal energy to maintain the highest temperature possible. The prior art requires mixing the returning liquors from the digester in the lowest temperature accumulator which allows liquor from 95° C. to the temperature of the lowest temperature accumulator displaced from the digester in the second displacement step to be thermally mixed creating a lower average temperature liquor for reuse in the digesters. The following table is a review of the displacing steps.

Low temperature liquor in the lowest temperature accumulator 12 (or from the storage side of the accumulator 53 if baffle 18 is present) has an effect on the initial delignification of cellulose bearing material such as wood because the extractive removal and initial delignification is more efficient and constant if the cooking chemicals from the lowest temperature accumulator 12 (or from the storage side of the accumulator 53 if baffle 18 is present) is around 130° C. versus the prior art of 110 to 115° C. Although the temperature of the lowest temperature accumulator 12 (or from the storage side of the accumulator 53 if baffle 18 is present) can be raised adding a steam or other type of heater, this consumes substantial amounts of energy. As noted the cause of low temperatures in the tank farm and specifically in the lowest temperature accumulator 12 (or from the storage side of the accumulator 53 if baffle 18 is present) is from channeling of low temperature displacing washer filtrate from the washer filtrate tank 70 through the digester and the mixing of the initial displaced liquors from the digester with the hotter final displaced liquors which cools the mixture.

In one aspect of this invention, using baffle 18 the production of 130° C. average liquor temperature in the storage side 53 of the lowest temperature accumulator 12 is created by continuing the first liquor filling from the storage side 53 of the lowest temperature accumulator 12 after the liquor leaving the digester 16 reaches above around 95° C. to eliminate the temperature gradient in the digester from the bottom to top. This is required since the next displacement step uses displacement liquor from the hotter temperature accumulator 14 to displace the digester liquor, the displaced liquor, to the lowest temperature accumulator 12. The method used to accomplish this is the returning liquor through line 20 is diverted through a new line 22 to the exit side of the lowest temperature accumulator 12 after the temperature reaches 95° C. This cool liquor is not mixed with the storage side 53 liquors of the lowest temperature accumulator 12 and therefore the temperature on the storage side increases since this liquor does not cool the mixture. The first step displacing operation is continued until the temperature at the top of the digester 16 is the same as the bottom. Liquors above around 95° C. are that are diverted to the outlet side 52 of the lowest temperature accumulator 12 and are safely cooled in the liquor cooler 32. In summary, the initial displacing step is extended to ensure that there is not a temperature gradient in the digester producing the highest possible temperature at the top of the digester 16 so that the subsequent displacing step does not lower the temperature of the receiving vessel, the

| Displacement Step | Tank Farm Liquors From/To | Displacing Liquors Temp | Displaced Liquors Temp | Final Dig Temp Gradient (Bot to Top) |
|---|---|---|---|---|
| PRIOR ART | | | | |
| 1 | Lowest Temp Accum*/ Atmospheric Tank | 110 to 115° C. | 75 to 95° C. | 110 to 95° C. |
| 2 | Higher Temp Accum/ Lowest Temp Accum | 140 and up | 95 to 140 and up | no (140° C.) |
| INVENTION | | | | |
| 1a | Lowest Temp Accum/ Atmospheric Tank and New Compartment | 130° C. | 75 to 130° C. | No (130° C.) |
| 2a | Higher Temp Accum/ Lowest Temp Accum | 155 and up | 130 to 155 and up | no (155° C.) |

*Accumulator lowest temperature accumulator 12, from the mixing of 95° C. from the liquor at the top of the digester. This requires diverting the displaced liquors after the temperature rises above around 95° C. to the outlet side 52 of the lowest temperature accumulator 12 so as not mix with the hotter liquors in the storage side 53 and to be safely cooled by the liquor cooler 32.

In another aspect of this invention, the mitigation of channeling in the digester is accomplished by maintaining a constant and minimum pressure drop across the digester contents with a constant flow rate. An inlet control valve 61 is added and is throttled using any one of the control techniques of gap action to the outlet pressure control valve 60 position, ratio control to the outlet pressure control valve 60, or multivariable matrix control (using top, bottom pressures) or other control technique to properly throttle the inlet control valve 61.

What is claimed:

1. In a process for producing pulp in a batch digester wherein during the cooking cycle of the digester spent cooking liquors displaced from previous batch cooks are used as a displacement liquor, the improvement comprising:

continuing the first displacing step of said cooking cycle to a point where the displaced liquor exiting the batch digester is at a temperature above 95° C.; separating said displacement liquor exiting the batch digester from liquor to be used in said first displacing step stored at a higher temperature to minimize vertical temperature gradients in said batch digester; and directing said displaced liguor exiting said digester to an outlet side of a lowest temperature accumulator in said process to prevent mixing with hotter liquors in a storage side of said accumulator.

2. In a process for producing pulp in a batch digester wherein during the cooking cycle of the digester spent cooking liquors displaced from previous batch cooks are used as a displacement liquor, the improvement comprising:

continuing the first displacing step of said cooking cycle to a point where the displaced liquor exiting the batch digester is at a temperature above 95° C.;

separating said displacement liquor exiting the batch digester from liquor to be used in said first displacing step stored at a higher temperature to minimize vertical temperature gradients in said batch digester;

directing said displaced liguor exiting said digester to an outlet side of a lowest temperature accumulator in said process to prevent mixing with hotter liquors in a storage side of said accumulator; and wherein said displaced liquor from said first displacement step sent to said accumulator is cooled and stored in an atmospheric storage tank.

* * * * *